United States Patent [19]

Neubauer et al.

[11] Patent Number: 4,615,717

[45] Date of Patent: Oct. 7, 1986

[54] METHOD AND APPARATUS FOR MAKING GLASS FIBER ORIENTED CONTINUOUS STRAND MAT

[75] Inventors: Jeffrey A. Neubauer, Lewisville, Tex.; Walter J. Reese, North Huntington, Pa.; Dennis O. Spencer, Shelby, N.C.

[73] Assignee: PPG Industries, Inc., Pittsburgh, Pa.

[21] Appl. No.: 780,777

[22] Filed: Sep. 27, 1985

[51] Int. Cl.[4] ..... C03B 37/085

[52] U.S. Cl. ..... 65/4.4; 65/3.44; 65/9; 28/112; 156/148; 156/181; 264/137; 264/153; 428/293

[58] Field of Search ..... 65/4.4, 9; 28/112, 344; 156/148, 181; 264/137, 153; 428/293

[56] References Cited

U.S. PATENT DOCUMENTS

| | | | |
|---|---|---|---|
| 2,855,634 | 10/1958 | Smart | 65/4.4 |
| 3,442,751 | 5/1969 | Langlois | 65/4.4 X |
| 3,506,420 | 4/1970 | Jackson et al. | 65/9 X |
| 3,511,625 | 5/1970 | Pitt | 65/4.4 X |
| 3,644,909 | 5/1972 | Ackley | 156/148 X |
| 3,684,645 | 8/1972 | Temple et al. | 156/148 X |
| 3,713,962 | 1/1973 | Ackley | 156/148 X |
| 3,850,723 | 11/1974 | Ackley | 156/180 |
| 3,883,333 | 5/1975 | Ackley | 65/2 |
| 3,913,037 | 11/1975 | Modigliani | 65/4.3 X |
| 3,915,681 | 10/1975 | Ackley | 65/9 |
| 4,158,557 | 6/1979 | Drummond | 65/2 |
| 4,208,000 | 6/1980 | Drummond | 226/171 |
| 4,277,531 | 7/1981 | Picone | 428/228 |
| 4,335,176 | 6/1982 | Baumann | 428/228 |
| 4,340,406 | 7/1982 | Neubauer et al. | 65/9 |
| 4,342,581 | 8/1982 | Neubauer et al. | 65/4.4 |
| 4,345,927 | 8/1982 | Picone | 65/4.4 |
| 4,404,717 | 9/1983 | Neubauer et al. | 28/107 |

*Primary Examiner*—Robert Lindsay
*Attorney, Agent, or Firm*—John E. Curley

[57] ABSTRACT

An oriented continuous strand mat of glass fiber filaments is formed by interleaved layers of generally circular or random loops and elongated elliptical loops having their longitudinal axes positioned in the direction of travel of an endless conveyor upon which the glass fibers are deployed to form a mat useable in a stampable glass fiber reinforced thermoplastic resin sheet having increased tensile strength in the length of the sheet. An elongated deflector plate having a planar deflecting surface whose length is aligned with the direction of conveyor travel, and whose face plane is generally perpendicular thereto receives pulled strands which have passed through an air flow nozzle and forms the strands into the elongated elliptical loops used to make the mat.

11 Claims, 3 Drawing Figures

METHOD AND APPARATUS FOR MAKING GLASS FIBER ORIENTED CONTINUOUS STRAND MAT

FIELD OF THE INVENTION

The present invention is directed generally to an oriented continuous strand mat. More particularly, the present invention is directed to an oriented continuous strand mat of glass fibers. Most specifically, the present invention is directed to an oriented continuous glass fiber strand mat having increased tensile strength in one direction. The oriented continuous glass fiber strand mat is formed by deploying continuous filaments of glass fibers onto the moving surface of a chain conveyor or other similar movable support surfaces. The filaments are deposited on the conveyor by a plurality of feeders which are structured to produce both generally circular filament arrays and generally elongated elliptical loop filament arrays. The two arrays are arranged in any desired pattern to produce a continuous glass fiber strand mat which, when incorporated in a thermoplastic resin forms a moldable sheet having superior high tensile strength in a desired direction. Elongated elliptical loop filament arrays are formed using an air jet nozzle and a planar, generally vertical, deflector plate positioned in the direction of travel of the chain conveyor.

DESCRIPTION OF THE PRIOR ART

Continuous strand glass fiber mats which are incorporated into suitable thermoplastic resins to form glass fiber reinforced thermoplastic resin sheet are generally known in the art. Exemplary of patents directed to these mats, sheets and processes and apparatus for their manufacture are the following patents, all of which are assigned to the assignee of the subject application:

U.S. Pat. No. 3,664,909: Ackley
U.S. Pat. No. 3,684,645: Temple et al
U.S. Pat. No. 3,713,962: Ackley
U.S. Pat. No. 3,850,723: Ackley
U.S. Pat. No. 3,883,333: Ackley
U.S. Pat. No. 3,915,681: Ackley
U.S. Pat. No. 4,158,557: Drummond
U.S. Pat. No. 4,208,000: Drummond
U.S. Pat. No. 4,277,531: Picone
U.S. Pat. No. 4,315,789: Tongel
U.S. Pat. No. 4,335,176: Baumann
U.S. Pat. No. 4,340,406: Neubauer et al
U.S. Pat. No. 4,342,581: Neubauer et al
U.S. Pat. No. 4,345,927: Picone
U.S. Pat. No. 4,404,717: Neubauer et al Typically forming continuous strand glass mats, a plurality of strand feeding assemblies are placed above a moving belt or conveyor which is preferably foraminous in nature. The strand feeders reciprocate back and forth parallel to each other and in a direction which is generally transverse to the direction of travel of the moving belt or conveyor. Strands of glass fiber filaments are fed to the strand feeders from suitable supply means, such as an array of forming packages in a support or creel, or from a plurality of glass fiber forming bushings. Each feeder includes a belt puller or a wheel puller assembly that provides the pulling force to take the strand from the supply and direct it down onto a chain conveyor or similar moving support. Initially, glass fiber strands were placed or deposited onto the chain conveyor from the wheel puller or belt puller directly. The several strand feeders each produced a generally sinusoidal array of strand material on the traveling belt. This was due to the relative motions of the reciprocating feeders moving transversely across the endless moving conveyor. A typical mat forming assembly uses twelve strand feeders so that the mat product was formed as an overlapping array of plural sinusoidal strands. These mats having the majority of strands running across the mat instead of along the length of the mat produced a glass fiber reinforced thermoplastic resin sheet usable in many stamping and forming processes.

The sinusoidal configuration of glass fiber strands sometimes resulted in a glass fiber reinforced thermoplastic resin sheets having non-controllable tensile strength characteristics so a deflector was employed intermediate the belt or wheel puller of the feeder assembly and the chain conveyor. Such as deflector, in the form of a convex surfaced disk or plate, is disclosed in U.S. Pat. No. 4,345,927. This convex deflector functions to provide a surface upon which the strands impinge, are somewhat separated into filaments, and fall onto the chain conveyor to form a mat having a reduced filament orientation. Fiber glass reinforced thermoplastic resin sheets formed using mats having reduced orientation glass fiber strands are more isentropic than were previous sheets having glass fibers formed in generally sinusoidal loops.

Recently, a demand has arisen for a stampable fiber glass reinforced thermoplastic sheet which will have increased tensile strength in the longitudinal direction of the mat. Exemplary of such a usage is in vehicle bumper back-up beams. Increased tensile strength in the longitudinal direction of the thermoplastic sheet can be accomplished by increasing the amounts of glass fiber strands in the longitudinal direction of the mat formed on the chain conveyor. An obvious way to accomplish this is to suspend a roll of strands above the chain conveyor and to deploy them onto the mat in the direction of chain travel. Unfortunately such a solution presents problems. First, strands must be placed on a beam which usually requires drying. Commercially acceptable mats are currently formed of wet strands from either wet forming packages or directly from bushings whose filaments are sized for such an application. The industry does not produce a wet roll beam in a suitable size for such an application. Even more importantly, in a sheet which will be stamped and molded, it is essential that the glass fiber reinforcement flows or moves with the thermoplastic resin sheet during stamping to provide a strong finished component. Continuous straight strands do not bend or deform when they are used in a mat which is then stamped or molded and thus, non-uniform reinforcement can result. Still further, if an end is lost on a beamed strand, the mat uniformity will be lost unless the entire length of mat is rethreaded where the end was lost. As may be seen in several of the above-recited prior patents, the layered mat is transferred from a first chain conveyor to a second adjacent conveyor for needling. Thus, in addition to providing the requisite strength in one direction, the mat must also be capable of transferring from the forming conveyor to other conveyors or equipment.

It will thus be seen that there is a need for a process and apparatus which will produce a layered glass fiber mat usable to form a stampable fiber glass reinforced thermoplastic resin sheet with increased strength in one direction. Such a sheet, can be produced from a plurality of the glass fiber reinforcing filaments which are deployed coextensive with the length of the formed sheet. Sheets having filaments so deployed have increased tensile strength in the longitudinal direction and are particularly desirable for certain applications such as; for example, automobile bumper back-up beams. The oriented continuous strand mat produced in accordance with the present invention provides such a product.

SUMMARY OF THE INVENTION

It is an object of the present invention to provide an oriented continuous strand mat.

Another object of the present invention is to provide an oriented, continuous loop strand mat.

A further object of the present invention is to provide an oriented, continuous strand, needled mat incorporatable with a thermoplastic resin to provide a stampable fiber glass reinforced thermoplastic resin sheet having high tensile strength in one direction.

Yet another object of the present invention is to provide an oriented, continuous strand, needled mat having interleaved layers of two types of oriented strands.

Still a further object of the present invention is to provide an apparatus for making an oriented continuous strand mat.

Yet another object of the present invention is to provide an oriented, continuous strand mat that is readily transferable from one conveyor to another conveyor during manufacture.

Even still a further object of the present invention is to provide an oriented, needled, continuous strand mat having elongated elliptical strand loops having their long axis oriented along the long axis of the mat conveyor.

As will be discussed in greater detail in the description of the preferred embodiment which is set forth subsequently, the oriented continuous strand mat in accordance with the present invention is comprised of interleaved layers of elongated elliptical strand loops and generally circular or randomly arrayed loops of strands of glass fiber filaments. A plurality of strand feeding assemblies are positioned adjacent each other above an elongated chain conveyor or other foraminous support. The several strand feeders each traverse back and forth across the chain conveyor in a direction generally perpendicular to the longitudinal direction of travel of the conveyor. Each strand feeder includes a strand pulling means such as a wheel or belt puller and each such strand feeder receives strands of glass fiber filaments from a supply which may be a forming package, roving ball, or may be a bushing assembly from which the filaments are attenuated.

The strands from the several feeding means are deployed on the traveling chain conveyor and build up in an interleaved, layered fashion. Selected ones of the strand feeders carry elongated deflector plates whose long dimension is colinear with the length of the chain conveyor. The deflecting surface of each such elongated deflector plate is generally planar and is positioned generally perpendicular to the chain conveyor. An air flow amplifier nozzle is positioned between the strand feeder and the deflector plate to direct strands passing through the nozzle against the deflector plate. This assemblage forms elongated elliptical loops of filaments as the strands strike the elongated deflector plate. These elongated loops then fall onto the chain conveyor with their long axis oriented along the length of the conveyor. Intermediate the spaced elongated loop forming strand feeders are positioned strand feeders which form loops having a smaller circular orientation. These circular loops are interleaved with the elliptical loops during mat formation and the composite loop orientation given to the finished mat gives the thermoplastic resin sheets into which these oriented continuous loops are incorporated higher tensile strength in the longitudinal direction of the so-formed sheets.

A thermoplastic resin sheet having an oriented, needled strand mat in accordance with the present invention is stampable or otherwise formable into numerous articles such as automotive bumper back-up beams which have a high tensile strength in the longitudinal direction of the sheet. Due to the continuous loop nature of the glass fibers forming the mat, the stamped articles have a generally uniform concentration of reinforcing filaments in all parts of the formed article. This is in contrast to a sheet formed from elongated discontinuous filaments which do not readily bend and flow with the thermoplastic resin during molding. Thus the sheets formed from mats made in accordance with the present invention are commercially useful.

The oriented continuous strand glass fiber mat in accordance with the present invention is formed on the chain conveyor as an interleaved array of elongated elliptical loop strands and interspaced, generally circular or randomly arrayed strands. Such a composite orientation of strand loops is readily transferrable from the first forming conveyor to the second adjacent needling conveyor without appreciable mat deformation. Such mat integrity is a result of the several different strand loop components shapes. While the elongated elliptical loops give high tensile strength in their long dimension, a mat made solely of such loops lacks the appropriate strength to allow handling during transfer from one conveyor to the next. The inclusion of generally circular or randomly arrayed loops results in a mat that is properly needleable and which has the requisite amount of tensile strength in all directions while having higher tensile strength in the longitudinal direction of the sheet into which the mat is incorporated.

The process of forming an oriented continuous strand mat in accordance with the present invention in which several different loop orientations are interleaved to form the composite mat results in a thermoplastic resin sheet having increased tensile strength in the longitudinal direction of the sheet when the mat of the present invention is incorporated therein. By using an air flow amplifying nozzle in conjunction with an elongated deflector plate which is positioned intermediate the strand feeder and the chain conveyor, the elongated loops of filaments are formed and deployed onto the chain conveyor in an expeditious manner. The process of mat forming and the apparatus used therefor in accordance with the present invention thus cooperate to form a mat usable to produce a stampable thermoplastic resin sheet having commercially desirable properties such as high tensile strength in the longitudinal direction of the sheet.

BRIEF DESCRIPTION OF THE DRAWINGS

While the novel features of the oriented, continuous strand mat in accordance with the present invention are set forth with particularity in the appended claims, a full and complete understanding of the invention may be had by referring to the detailed description of the preferred embodiment, as is set forth hereinafter, and as may be seen in the accompanying drawings in which:

DESCRIPTION OF THE PREFERRED EMBODIMENT

Figure 1:
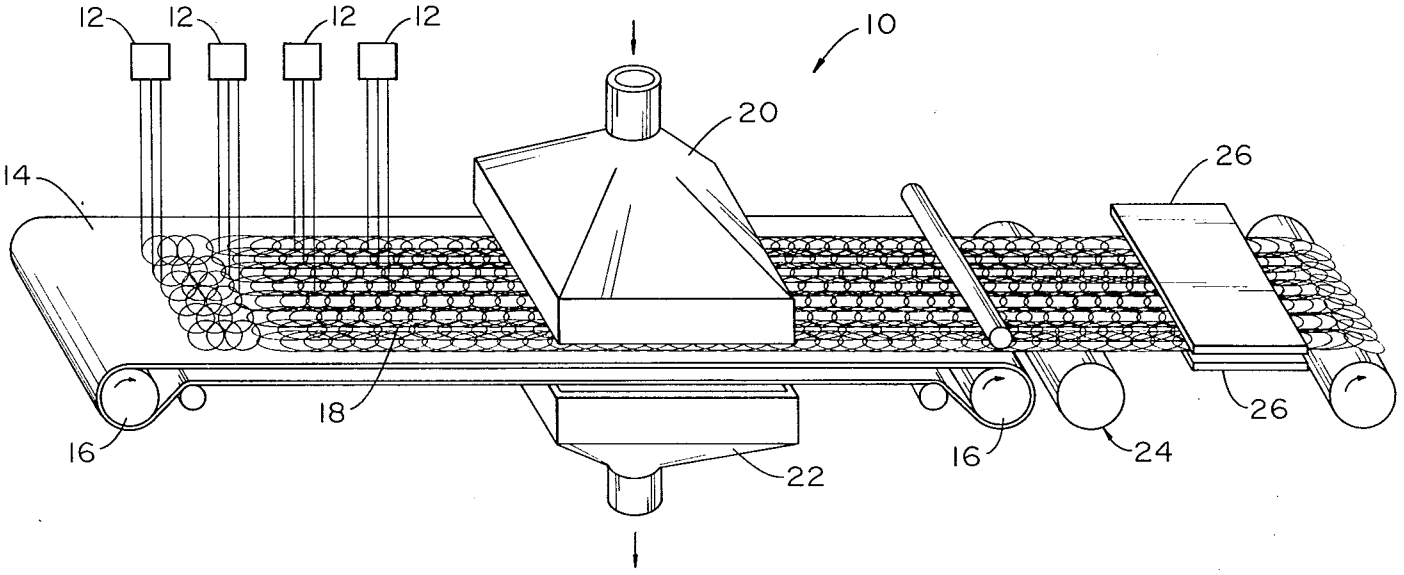
FIG. 1 is a schematic perspective view of a continuous strand mat forming assembly in accordance with the present invention.

Referring initially to FIG. 1, there may be seen generally at 10 a somewhat schematic representation of an assembly for making an oriented continuous strand mat in accordance with the present invention. Such mat forming assemblies are know generally, as may be seen in U.S. Pat. Nos. 3,883,333 and 4,404,717, both of which are assigned to the assignee of the present application and both of whose disclosures are incorporated herein by reference. While a rigorous discussion of this generally known mat forming assembly is not believed necessary at this juncture, the following overview will facilitate understanding of the present invention. A plurality of strand feeders, generally indicated at 12, are positioned above an endless conveyor 14 which is driven by spaced drive rollers 16. Endless conveyor 14 has a foraminous surface and is typically a chain conveyor. Each strand feeder 12 is supported for movement above chain conveyor 14 with the movement of each strand feeder 12 being generally transverse to the direction of motion of chain conveyor 14, with chain conveyor 14 moving from left to right in FIG. 1. Chain conveyor 14 will thus be understood at moving in its longitudinal direction while the various strand feeders 12 move back and forth across and above chain conveyor 14. Each of the strand feeders 12 is supplied with glass fiber strands from a suitable supply source which may be a forming package, roving ball or a filament forming bushing assembly.

If the supply is from a bushing, the process shown and described in U.S. Pat. No. 3,883,333 may be employed and is preferred if the strands used by feeders 12 are made directly from a molten glass source. As shown in that patent, the fibers of glass are drawn from a molten glass source gathered into strands and the strands are then fed directly to mat conveyor.

If the strands are supplied from forming packages or roving, the packages or roving are placed on creels and the strands or rovings are pulled from the creeled packages. Whatever the supply source, the strands are pulled therefrom by the strand feeders 12 and are deployed back and forth across the width of the moving endless chain conveyor 14. In FIG. 1 only four strand feeders are schematically shown. It will be understood that in a typical manufacturing assembly sixteen such strand feeders are positioned serially one after another above chain conveyor 14. Twelve of these strand feeders 12 are primary feeders and the four remaining feeders are back ups which automatically begin to operate upon failure of one of the original twelve.

The strands pulled by the active strand feeders 12 are laid down on the chain conveyor in an endless interleaved manner to form a continuous strand mat, shown schematically at 18 in FIG. 1. The various filaments deposited on chain conveyor by the various strand feeders 12 are, in accordance with the present invention, oriented in a specific pattern or manner to form a mat 18 having particular properties. It will be understood that the several strand feeders 12 are controlled to form a mat 18 having a generally constant width and a constant thickness, which thickness can be controlled by varying either strand traverse speeds, chain speed, or both.

Once mat 18 has been formed on chain conveyor 14 by the interleaving and interlayering of the plurality of oriented continuous strand loops in accordance with the present invention, as formed by the strand feeders in a manner to be discussed more fully subsequently, the mat 18 is passed under suitable drying means represented by an overhead hot air discharge hood 20 and a cooperating air exhaust duct 22. The formed mat is then transferred from chain conveyor 14 to a second needling conveyor 24 where it passes between generally known spaced needling boards 26. Here a plurality of barbed needles are used to intertwine the filaments of the mat to thereby inpart the mechanical strength of the mat 18. The needling process is described in assignee's U.S. Pat. No. 4,335,176.

Continuous strand glass fiber mats formed generally in the manner set forth hereinabove have found great utility as reinforcement for thermoplastic resin sheets to form stampable glass fiber reinforced thermoplastic resin sheets. The sheets formed in the past have been directed to ones having isentropic properties; i.e., properties such as tensile strength which are equal in all directions. However, new industrial uses, such as stamped automotive bumper back-up beams have specified a sheet having increased tensile strength in the longitudinal direction of the sheet. This means that the continuous strand mat used to make such a sheet must have a higher concentration of strands or filaments in the longitudinal direction of the mat. As was discussed earlier such a strand concentration is not accomplishable merely by interleaving a plurality of straight endless strands in the mat since a sheet formed of such a mat may not stamp and form properly. Applicants have found that the strands may be formed in elongated loops having a generally elliptical shape with the long axis of the ellipse being oriented in the longitudinal direction of the endless mat conveyor 14, and mat formed therefrom will possess the desired directional strength characteristics. In a preferred process, the elongated ellipsoidal loops are interleaved with conventional circular loops to provide sufficient mechanical strength and mat integrity to properly transfer the mat from the chain conveyor 14 to the needling conveyor 24. When only elliptical loops are employed, it is found that on occasion the mat tends to wrap around roll 16. This will cause the operation to be shut down for clearing of the roll prior to restart. Consequently, in accordance with the preferred mode of the invention, it has been found that a suitable mat 18, useable to produce stampable fiber glass reinforced thermoplastic resin sheets having increased tensile strength in the longitudinal direction of the sheets, may be formed as an oriented continuous strand mat having interleaved or interlayered arrays of different shaped layers of strands or filaments. Particularly, in accordance with the preferred embodiment of the present invention, there are provided both circular or randomly arrayed layers of filaments and layers of elongated elliptical continuous loops or strands. While various layering patterns can be utilized for particular requirements, it has been determined in accordance with the preferred embodiment of the present invention that a mat having circular or randomly arrayed loops of strands or filaments as the top and bottom layers and as every third layer thereinbetween, with the other two layers between the circular or random loop layers being of the elongated elliptical strand type, i.e., having a long axis arranged in the longitudinal direction of the mat, will form a mat that is mechanically strong and that has the properties of increased tensile strength in the longitudinal direction of the sheet and which will transfer from the forming conveyor to other moving surfaces with ease.

Figure 2:
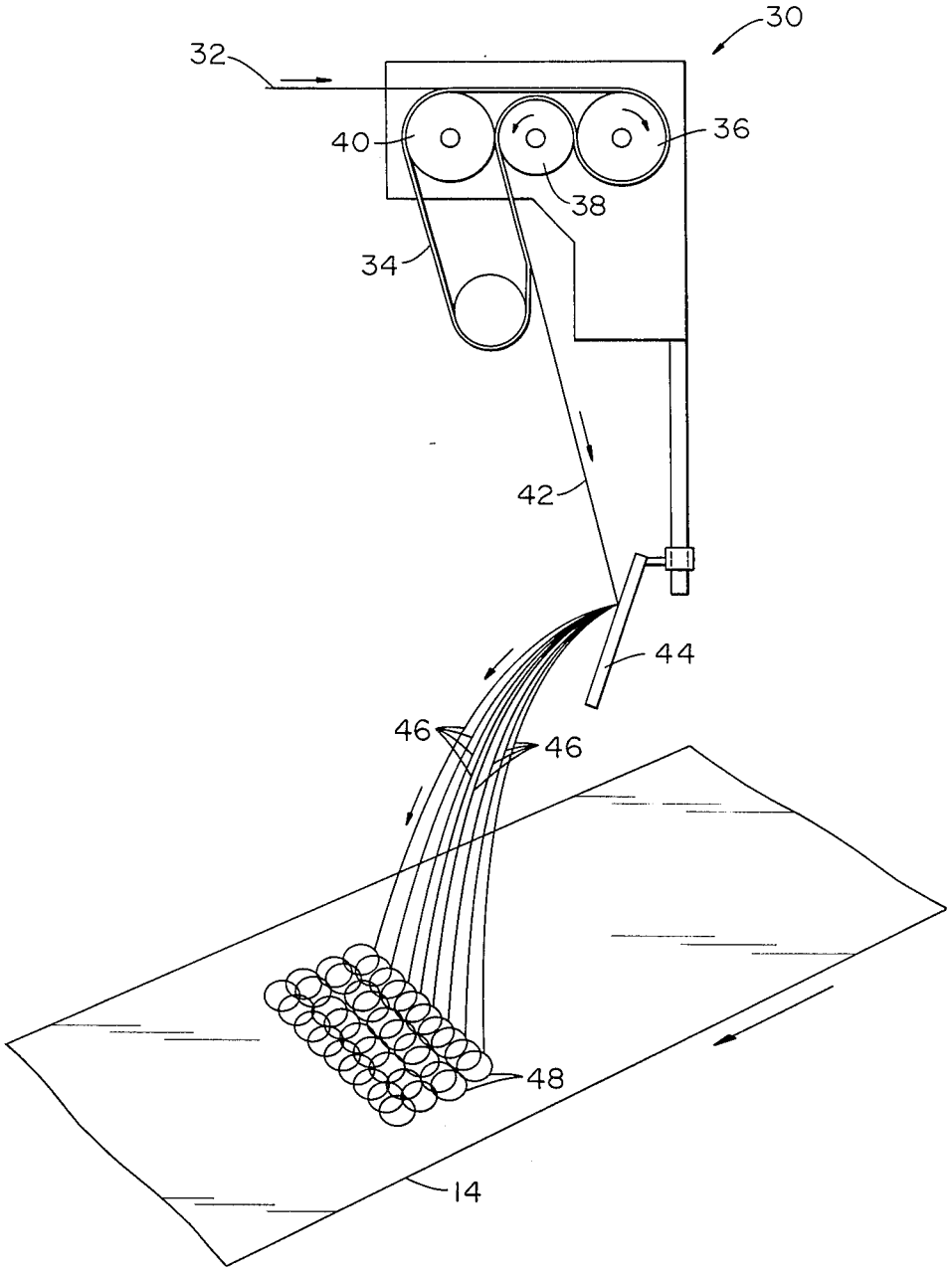
FIG. 2 is a schematic perspective view of a generally known prior art strand feeder and deflector plate assembly.
Figure 3:
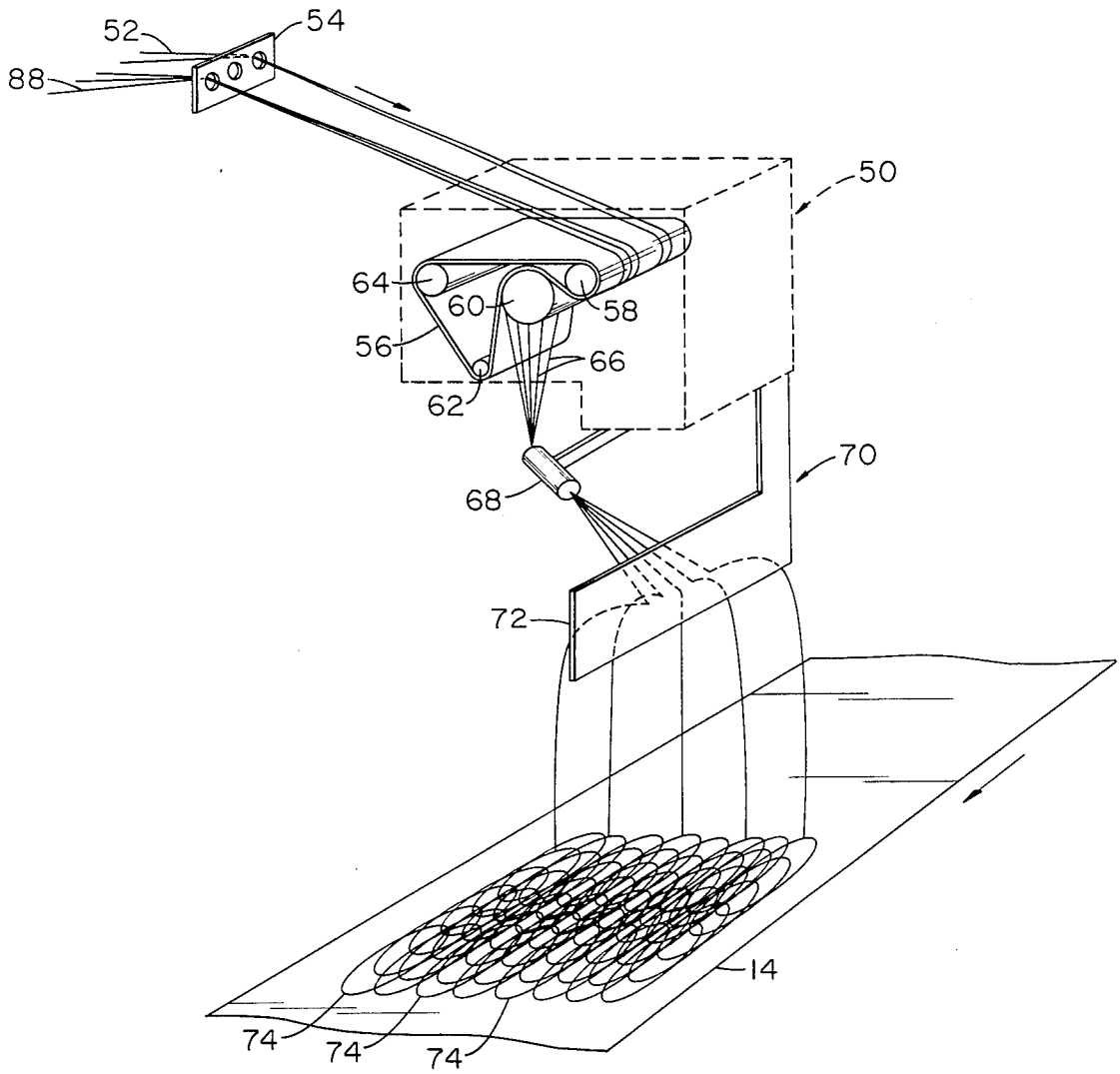
FIG. 3 is a schematic perspective view of a strand feeder having an air flow amplification nozzle and a deflector plate in accordance with the present invention.

Turning now to FIGS. 2 and 3 there may be seen strand feeders useable to form the circular loop and elliptical loop continuous strand or filament arrays. Circular strand feeder 30 is generally similar to the assembly shown in U.S. Pat. No. 4,345,927, assigned to the assignee of the present application and whose disclosure is incorporated herein by reference. Circular strand feeder 30 receives strands 32 from a suitable source of supply and feeds the strands by way of an endless belt 34 between spaced driven pulling wheels 36, 38 and 40. The pulled strands 42 are then fed against a deflector plate 44 structured to produce a plurality of filaments 46 which are deposited onto chain conveyor 14 as a plurality of generally small circular loops 48. While not specifically shown, it will be understood that circular strand feeder 30 is continually traversed across above the surface of chain conveyor 14 so that the continuous array of small circular or randomly oriented loops of filaments will be deployed across the chain conveyor 14 at a width determined by the width of the sheet to be formed.

Referring now more particularly to FIG. 3, there may be seen an elliptical strand feeder 50 in accordance with the present invention. Strands or filaments 52 from a suitable supply package array or from bushing assemblies (not shown) are fed through a guide bushing 54 and onto an endless pulling belt 56 of conventional design. This belt 56 and the strands 52 are passed about pulling wheels 58, 60, 62, and 64 and the pulled strands 66 are then fed into an air flow nozzle 68. A suitable nozzle for such useage is set forth in U.S. Pat. No. 4,046,492 which is assigned to Vortec Corporation of Cincinnati, Ohio. Air flow nozzle 68 is supplied with compressed air from a suitable supply source (not shown) and acts to redirect the direction of travel of the pulled strands or filaments 66. Air flow nozzle 68 does not increase the speed of travel of strands 66 since this speed has been established by the belt puller 56. However, air nozzle 68, in addition to redirecting the strands, does also appear to have an aspirating effect on the strands and greatly reduces filament wrappage on pulling wheel 60, for example.

Pulled strands 66 pass through air flow nozzle 68 and are directed against an elongated deflector plate, generally at 70, which is carried by, and moves with elliptical strand puller 50 back and forth in a transverse manner above endless conveyor chain 14. Elongated deflector plate 70 has a planar deflecting face 72 whose longitudinal elongated dimension is generally parallel to the direction of chain conveyor 14's travel. The plane of deflectory face 72 is generally perpendicular to the surface of conveyor 14. Air nozzle 68 is also carried by elliptical strand feeder 50 and is oriented so that the pulled strands 66 which pass therethrough impinge against planar deflecting face 72 of the elongated deflector plate 70 at a substantial angle. These strands hit planar deflecting face 72 and are divided into filamentary arrays which disperse forwardly and rearwardly along planar deflecting face 72 to form continuous elongated elliptical loops 74 that are then deposited onto the surface of chain conveyor. As may be seen in FIG. 3, the longitudinal length or axis of the elongated elliptical loops 74 is oriented along the longitudinal length or direction of travel of chain conveyor 14. The degree of elongation of the continuous loops 74 of filaments 66 is regulatable by controlling such variables as the speed of traversal of strand pulley 50 above conveyor 14, the speed at which the pulled strands 66 are delivered to air flow nozzle 68, the air flow through nozzle 68, and the speed of travel of chain conveyor 14. By proper adjustments of these variables, a pattern of elongated elliptical loops of continuous strands can be deployed on chain conveyor 14 in a desired pattern.

As was discussed previously, the several serially arranged strand feeders are, in accordance with the present invention, arranged in a fashion that, in a preferred embodiment, places a layer of circular or random filaments from a circular feeder 30 on the top and bottom surfaces of the mat and as every third layer thereinbetween. The two adjacent layers between each third circular layer of strands are layers of elliptical elongated lops formed by elliptical strand feeders 50. It will of course be understood that various other layering or interleaving patterns are possible by proper selection and positioning of the circular and elliptical strand feeders 30 and 50, respectively. Thus, as shown in FIG. 1, the first feeder on the left side of the drawing and the next two feeders are lying down circular strands and the fourth feeder, elliptical strands.

The glass fiber mat 14 formed by the interleaving of the small circular or random loops of filaments formed by circular strand feeders 30 and the elongated elliptical loops of filaments formed by elliptical strand feeders 50, are incorporated into thermoplastic resinous sheets to form stampable fiber glass reinforced thermoplastic resin sheets having increased tensile strength in the longitudinal direction of the sheet. The needled mats are then impregnated with a hot molten thermoplastic from an extruder and after thorough impregnation in a suitable press, the resin is cooled to form the finished fiber glass reinforced thermoplastic resin sheet. One such process, which is continuous, is described in assignee's German Pat. No. 2948235. A batching operation to also produce such laminates is described in assignee's U.S. Pat. No. 3,713,962, where the laminates are made from mat and thermoplastic sheets, which are melted in the laminating press to provide the resin impregnating the mat and other subjected to cooling to produce the finsihed sheets. The impregnation of mats prepared in accordance with this invention with resins generally involves a continuous operation which involves feeding molten thermoplastic resin between two mats and two thermoplastic sheets, one over each mat into a laminating zone where pressure is applied to the sandwich of resin sheets, mat and molten plastic for a period of time sufficient to allow the mat to be thoroughly impregnated. The mat and resin are then cooled in a similar pressure zone to solidify the resin and form the finished sheets. This is a continuous process with material continuously leaving from the hot to the cold end and is shown clearly in assignee's German Pat. No. 2948235.

The sheets resulting from these operations form stampable, fiber glass reinforced thermoplastic resin sheets having increased tensile strength in the longitudinal direction of the sheet. This is due to the increased filament concentration in the longitudinal direction which is a result of the elliptical shape of the continuous loops formed by the elongated deflector plate 70 of the elliptical strand feeders 50. Further, since these reinforcements are continuous loops instead of discontinuous strips or threads, the stamped products are uniform in fiber concentration due to the ability of the glass fiber reinforcements to bend and move with the resins. Thus a commercially desirable and useable product is formed by the apparatus and in accordance with the method of the present invention.

Typical thermoplastic resins suited for preparing these products are homopolymers and copolymers of resins such as: (1) vinyl resins formed by the polymerization of the vinyl halides or by the copolymerization of vinyl halides with unsaturated polymerizable compounds, e.g., vinyl esters; alpha, beta-unsaturated acids; alpha, beta-unsaturated esters; alpha, beta-unsaturated ketones; alpha, beta-unsaturated aldehydes and unsaturated hydrocarbons such as butadienes and styrenes; (2) poly-alpha-olefins such as polyethylene, polypropylene, polybutylene, polyisoprene and the like including copolymers of poly-alpha-olefins; (3) phenoxy resins; (4) polyamides such as polyhexamethylene adipamide; (5) polysulfones; (6) polycarbonates; (7) polyacetyls; (8) polethylene oxide; (9) polystyrene, including copolymers of styrene with monomeric compounds such as acrylonitrile and butadiene; (10) acrylic resins as exemplified by the polymers of methyl acrylate, acrylamide, metholoacrylamide, acrylonitrile and copolymers of these styrene, vinyl pyridines, etc.; (11) neoprene; (12) polyphenylene oxide resins; (13) polymers such as polybutylene terephthalate and polyethyleneterephthalate; and (14) cellulose esters. This list is not meant to be limiting or exhaustive but merely illustrates the wide range of polymeric materials which may be employed in the present invention.

It is also contemplated that fillers may be employed in the thermoplastic resins where desired. These fillers can be any of a variety of conventional resin fillers known in the art, talc, calcium carbonate, clays, diatomaceous earths being a few of those typically used.

While a preferred embodiment of an oriented continuous strand mat of glass fiber filaments in accordance with the present invention has been set forth fully and completely hereinabove, it will be evident to one of ordinary skill in the art that a number of changes in; for example, the type of chain conveyor, the strand feeder traversing means, the type of strand puller such as a belt or wheel used, and the like can be made without departing from the true spirit and scope of the present invention which is to be limited only by the following claims.

We claim:

1. A process for forming a glass fiber mat from a molten glass source, comprising the steps of:

forming a plurality of glass fibers from a molten glass; gathering the fibers into glass fiber strands;

feeding the said glass fiber strands to a plurality of strand feeders positioned serially above an endless conveyor;

traversing said plurality of strand feeders transversely across said endless conveyor while said endless conveyor is moving generally perpendicularly to the direction of traversal of said strand feeders;

causing selected first ones of said strand feeders to form first small circular or random loops of continuous strands on said endless conveyor; and causing selected second ones of said strand feeders to form second elongated, generally elliptical loops of continuous glass on said endless conveyor, said first and said second loops of continuous strands being interlayered on said endless conveyor to form said glass fiber mat, and needling said mat to entangle the glass fibers and impart mechanical integrity to the mat.

2. The process of claim 1 further including providing said selected second ones of said strand feeders with deflector plates having planar deflecting faces and directing said continuous strands of glass fibers from said second strand feeders against said planar deflecting faces to form said elliptical loops of continuous glass fiber strands.

3. The process of claim 2 further including directing said strands from said selected second strand feeders through an air flow nozzle positioned intermediate said second feeders and said elongated deflector plates.

4. The process of claim 2 further including orienting said planar deflecting face generally parallel to the direction of travel or said endless conveyor and generally perpendicular to the surface thereof.

5. The process of claim 1 further including positioning said first ones of said strand feeders as the first and last feeders in said serial array of strand feeders and further including positioning said second ones of said strand feeders intermediate additional ones of said first strand feeders.

6. A process for forming a glass fiber mat useable in a stampable glass fiber reinforced thermoplastic resin sheet having increased tensile strength in the longitudinal direction of the sheet, said process comprising the steps of:

feeding glass fiber strands to a plurality of strand feeders positioned serially above an endless conveyor;

traversing said plurality of strand feeders transversely across said endless conveyor while said endless conveyor is moving generally perpendicularly to the direction of traversal of said strand feeders;

causing selected first ones of said strand feeders to form first small circular or random loops of continuous strands on said endless conveyor; and causing selected second ones of said strand feeders to form second elongated, generally elliptical loops of continuous strands of glass fiber filaments on said endless conveyor, said first and said second loops of continuous strands being interlayered on said endless conveyor to form said glass fiber mat.

7. The process of claim 6 further including positioning two of said second strand feeders intermediate each two of said first strand feeders.

8. An apparatus useable to form an oriented continuous strand mat for use in a stampable glass fiber reinforced thermoplastic resin sheet having increased tensile strength in the longitudinal direction of the sheet, said apparatus comprising:

an elongated, endless foraminous surfaced conveyor;

a plurality of first and second strand feeders positioned above said endless conveyor;

means to reciprocate each of said strand feeders transversely across said endless conveyor in a direction generally perpendicular to the direction of travel of said endless conveyor;

means to supply glass fiber strands from a supply means to each of said first and second strand feeders;

means associated with each of said first strand feeders to form filaments of strands fed thereto into small circular or random loops for deposition on said endless conveyor; and means associated with each of said second strand feeders to form filaments or strands fed thereto into elongated elliptical continuous loops, said circular or random filaments and said elongated elliptical filaments being interleaved on said conveyor to form said oriented continuous strand mat.

9. The apparatus of claim 8, wherein each of said second strand feeders includes an elongated deflector plate having a generally planar deflecting face.

10. The apparatus of claim 9, wherein said generally planar deflecting face has a longitudinal dimension generally parallel to the direction of travel of said endless conveyor and said planar deflecting face is positioned generally perpendicular to said endless conveyor.

11. The apparatus of claim 9, wherein an air flow nozzle is positioned intermediate each of said second strand feeders and each said elongated deflector plate and directs pulled strands passing therethrough against said planar deflecting face.

* * * * *